US006681949B2

(12) United States Patent
Tibor

(10) Patent No.: US 6,681,949 B2
(45) Date of Patent: Jan. 27, 2004

(54) TORQUING-LIMITING APPARATUS

(76) Inventor: Kenneth R. Tibor, 8612 3rd Ave., Pleasant Prairie, WI (US) 53158

( * ) Notice: Subject to any disclaimer, the term of this patent is extended or adjusted under 35 U.S.C. 154(b) by 0 days.

(21) Appl. No.: 10/152,948

(22) Filed: May 21, 2002

(65) Prior Publication Data

US 2003/0218018 A1 Nov. 27, 2003

(51) Int. Cl.[7] ..... B65D 41/04
(52) U.S. Cl. ..... 220/288; 220/304; 220/601
(58) Field of Search ..... 220/288, 304, 220/315, 601, 284; 215/302, 303, 296; 411/911, 1, 6, 7, 8, 9, 10, 11

(56) References Cited

U.S. PATENT DOCUMENTS

| | | | | |
|---|---|---|---|---|
| 1,882,097 A | | 10/1932 | Stant | |
| 3,124,267 A | | 3/1964 | Cetrone | 220/39 |
| 3,715,075 A | | 2/1973 | Blau et al. | 220/39 |
| 3,820,680 A | | 6/1974 | Friend | 220/39 |
| 3,986,634 A | * | 10/1976 | Smith et al. | 220/288 |
| 4,809,869 A | | 3/1989 | Cosgrove et al. | 220/288 |
| 5,110,003 A | | 5/1992 | MacWilliams | 220/304 |
| 5,197,616 A | | 3/1993 | Buono | 215/220 |
| 5,449,086 A | * | 9/1995 | Harris | 220/288 |

* cited by examiner

*Primary Examiner*—Lee Young
*Assistant Examiner*—James Smalley
(74) *Attorney, Agent, or Firm*—Whyte Hirschboeck Dudek SC

(57) ABSTRACT

Apparatus for limiting torque comprising a torque ring rotatably seatable upon a plug and a torque collar securable to the plug and holding the torque ring rotatably captive. Torque ring includes a torque ring aperture and an axially-protruding resilient finger. Torque collar includes a torque collar aperture and a finger aperture. Closing-direction torque applied to torque ring is transferred to torque collar and then to plug to rotate plug in the closing direction. Rotation continues until torque overcomes a resisting force wherein finger disengages from finger aperture, torque ring rotates relative to torque collar, and the amount of closing-direction torque that can be applied is limited. Opening-direction torque and rotation of plug is without limit. Over-compressing or under-compressing of gaskets can be eliminated and containers can be inhibited and/or prevented from leaking. The apparatus is compatible with both new and used plugs.

59 Claims, 6 Drawing Sheets

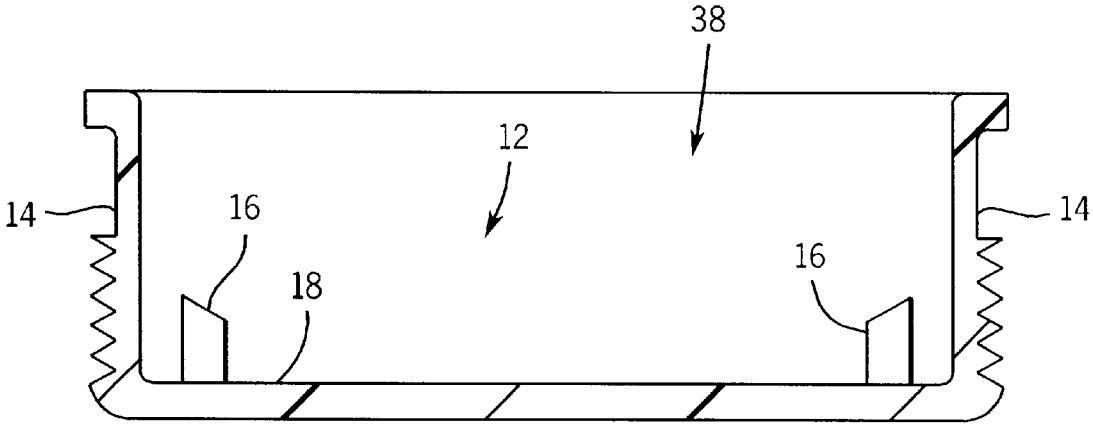
FIG. 2
PRIOR ART
FIG. 3
PRIOR ART
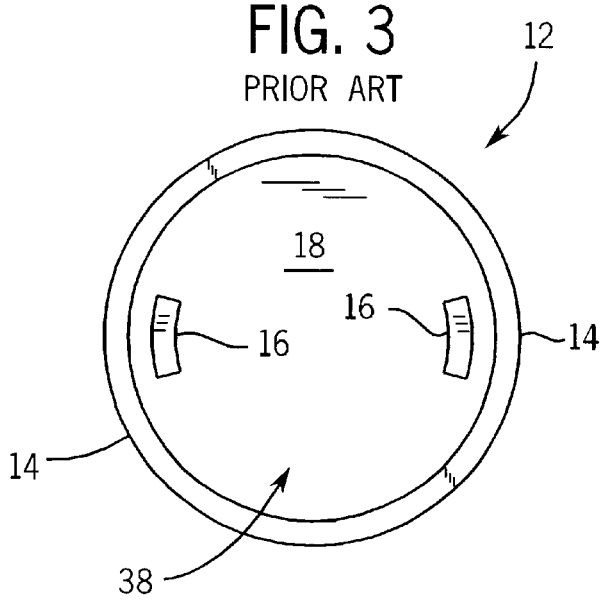

TORQUING-LIMITING APPARATUS

BACKGROUND OF THE INVENTION

1. Field of the Invention

The present invention generally relates to an apparatus and system for applying limited torque to a plug. In one aspect, the invention relates to an apparatus that can be secured to a new or used plug to limit the torque that can be applied in a closing direction to the plug when the plug is used to seal a container.

2. Description of the Related Art

A typical sealing assembly for a container comprises a plug, a tab used to rotate the plug, a gasket associated with the plug, and a flange secured within a container. When a torque-providing device (e.g., wrench, torque wrench, etc.) applies torque (i.e., a rotational force) to the tab in a closing direction, the plug rotates in the closing direction such that the plug is threadably received within the flange. As rotation in the closing direction continues, the gasket is compressed between the plug and the flange. Compression of the gasket between the plug and the flange is expected to form a liquid-impermeable seal, thereby sealing the container and preventing the container from leaking.

Unfortunately, if an inappropriate amount of torque is administered to the plug, the liquid-impermeable seal will not be formed and the container can leak. For example, if too much torque is applied to the plug, the gasket can be too forcefully compressed, potentially damaging the gasket. On the other hand, if too little torque is applied to the plug, the gasket will not be compressed forcefully enough and the liquid-impermeable seal cannot be achieved. In either case, leaking of the container can result. To ensure the proper application of torque, and consequently prevent the containers from leaking, several solutions have been suggested.

One solution known to combat over-torquing the plug and/or over-compressing the gasket calls for the use of a torque wrench to provide torque to the tabs. A torque wrench is a device that is calibrated to permit the application of a limited amount of torque to a component such as, for example, the plug. When the limited amount of torque has been delivered, the torque-wrench provides a signal to a torque wrench operator by "slipping", "giving", and/or "breaking-away". The torque wrench can be configured such that the limited torque that is applied to the plug equals the torque necessary to form the liquid-impermeable seal with the compressed gasket. Therefore, by using the torque wrench, the limited torque is theoretically guaranteed to be delivered. However, the torque wrench is often improperly or unskillfully used. All too frequently, the torque wrench operator fails to perceive, or simply ignores, the signal provided by the torque wrench. As such, the torque wrench operator can apply, despite the torque wrench If signal, too much torque to the plug. Therefore, the gasket is over-compressed and the sealing assembly can permit the container to leak. Thus, the solution of employing the torque wrench to deliver the limited amount of torque is often ineffectual.

Another solution to the problem of over-torquing the plug and/or over-compressing the gasket proposes using a torque-limiting device with the plug. As known in the art, such torque-limiting devices typically contain an independent, helical compression spring. For example, in U.S. Pat. No. 4,809,869 to Cosgrove, et. al., pawls, biased by a helical compression spring, engage with ratchet teeth as torque is applied. When the torque becomes excessive, the pawls and ratchet teeth disengage. Also, in U.S. Pat. No. 3,715,075 to Blau, et. al., coupling members, biased by a helical compression spring, engage with groove-like recesses as torque is applied. Again, when the torque becomes excessive, the coupling members and the groove-like recesses disengage. While the torque-limiting apparatus of both Cosgrove and Blau may be useful for some applications, each apparatus critically relies on the independent, helical compression springs to limit the amount of torque. Since each helical compression spring is an integral component within the torque-limiting device/plug combination, it would be difficult, if not impossible, to efficiently fit, retro-fit, and/or adapt the torque-limiting devices disclosed in Cosgrove and Blau to a used, existing, recycled, or previously manufactured plug. Thus, such torque-limiting devices fail to provide the most practical and cost-efficient solution to the problem of over-tightening the plug and/or over-compressing the gasket which can result in container leakage.

Another proposed solution to the problem of over-torquing the plug and/or over-compressing the gasket involves a more indirect remedy. This solution uses a sealing cap (i.e., a safety cap) in combination with the typical sealing assembly. After the plug has been rotated to compress the gasket between the plug and the flange, the sealing cap is crimped onto, and over, the flange and/or the sealing assembly. Thus, the sealing cap can protectively cover the plug and the gasket. This indirectly prevents the container from leaking even if the gasket fails. While the use of the sealing cap may prevent the container from leaking, the sealing cap neglects the underlying problem (i.e., a damaged or ineffectual gasket). Further, if the plug is to be subsequently removed from the container, reused, and/or recycled, the sealing cap must be damaged to access the plug. A new sealing cap can be required each time the container is to be sealed and/or resealed. As such, maintaining container integrity can become expensive. Therefore, sealing caps provide a less durable and/or less comprehensive solution to the fundamental problem of over-torquing the plug and/or over-compressing the gasket.

Thus, an apparatus and system that can limit torque applied to a plug by a torque-producing device, permit a gasket to be compressed between the plug and a flange in a container until a liquid-impermeable seal is formed, prevent damage to the gasket, and seal the container, would be highly desirable. Likewise, the apparatus would be constructed of few components and be utilized with used and/or existing plugs.

SUMMARY OF THE INVENTION

In one aspect, the invention provides an apparatus for limiting torque applied by a torque-providing device. The apparatus can comprise a torque ring rotatably seatable upon a plug and a torque collar securable to the plug and holding the torque ring rotatably captive. The torque ring includes a torque ring aperture that engages the torque-providing device and an axially-protruding resilient finger that provides a resisting force. The torque collar has a torque collar aperture that receives the torque-providing device and a finger aperture that receives and engages the axially-protruding resilient finger. When torque is applied to the torque ring by the torque-providing device in a closing direction, the axially-protruding resilient finger engages the finger aperture to transfer torque from the torque ring to the torque collar. This permits the torque collar to rotate the plug in the closing direction until torque overcomes the resisting force of the axially-protruding resilient finger. When this occurs, the axially-protruding resilient finger disengages from the finger aperture. As a result, the torque ring continues to rotate in the closing direction independent of the torque collar and the plug.

Disengagement of the axially-protruding resilient finger from the finger aperture can occur when the axially-protruding resilient finger is biased toward the plug, biased away from the torque collar, flattened by the torque collar, forced axially downwardly, radially urged downwardly, and/or bent flush with the torque ring. Therefore, disengagement can cause the axially-protruding resilient finger to temporarily deform such that the finger is not axially-protruding from the torque ring. Also, disengagement can ensure that a gasket, used in conjunction with the plug, is not damaged and a container is sealed. Further, the plug can be removed from being sealably inserted within the container without damage occurring to the plug.

The resisting force can be determined by friction generated between the axially-protruding resilient finger and the torque collar or by upward protrusion of the axially-protruding resilient finger and friction generated between the axially-protruding resilient finger and the torque collar. Because the resisting force is mechanically determined, the apparatus can eliminate human error by automatically disengaging when the torque applied to the torque ring overcomes the resisting force.

In one embodiment, the apparatus can be employed with used plugs. In other words, the apparatus can be retro-fitted upon the used plugs. In another embodiment, torque can be applied to the torque ring by the torque-providing device in an opening direction. When this occurs, the axially-protruding resilient finger engages the finger aperture such that torque is transferred to the torque collar and causes the plug to rotate in the opening direction until the torque is no longer applied by the torque-providing device.

The axially-protruding resilient finger can include a front surface and a friction surface, the friction surface providing a resisting force. Also, the torque collar can define a sliding surface while the finger aperture can define a camming surface.

In another aspect, the invention comprises an assembly for limiting torque applied by a torque-providing device. The assembly can include a plug having a periphery, a gasket disposed upon the plug proximate the periphery, and an apparatus secured to the plug. The apparatus can comprise a torque ring and a torque collar. The torque ring, rotatably seatable upon the plug, can include a torque ring aperture that engages the torque-providing device and an axially-protruding resilient finger that provides a resisting force. The torque collar, securable to the plug and holding the torque ring rotatably captive, can include a torque collar aperture that receives the torque-providing device and a finger aperture that receives and engages the axially-protruding resilient finger.

When torque is applied to the torque ring by the torque-providing device in an opening direction, the axially-protruding resilient finger engages the finger aperture to transfer the torque from the torque ring to the torque collar. This permits the torque collar to rotate the plug in the opening direction until the torque is no longer applied by the torque-providing device.

Also, when torque is applied to the torque ring by the torque-providing device in a closing direction, the axially-protruding resilient finger engages the finger aperture to transfer the torque from the torque ring to the torque collar. This permits the torque collar to rotate the plug in the closing direction and compress the gasket until the torque overcomes the resisting force of the axially-protruding resilient finger. When torque overcomes the resisting force, the axially-protruding resilient finger disengages from the finger aperture. This results in the torque ring continuing to rotate in the closing direction independent of the torque collar and the plug such that the torque applied to the plug in the closing direction is limited and the compressed gasket is not damaged. Thus, containers using the assembly can be sealed and prevented from leaking.

In another aspect, the invention comprises a system for sealing. The system can include a plug having a periphery, a gasket disposed upon the plug proximate the periphery, a container, and a torque-limiting apparatus. The container can include a flange that threadably receives the plug and the gasket. Thus, the flange and the plug can compress the gasket thereby sealing the container.

The container in the system can be a 55-gallon metal drum and the flanges can be two-inch flanges and/or three-quarters inch flanges. The system can further comprise a cap seal that provides protection from leaks. The cap seal is typically secured to the plug after the plug has been secured in the flange within the container.

In another aspect, the invention comprises a method of limiting torque applied by a torque-providing device. The method comprises providing a plug having a torque-limiting apparatus which includes a torque ring and a torque collar. The torque ring, rotatably seatable upon the plug, can have a torque ring aperture that engages the torque-providing device and an axially-protruding resilient finger that provides a resisting force. The torque collar, securable to the plug and holding the torque ring rotatably captive, can have a torque collar aperture that receives the torque-providing device and a finger aperture that receives and engages the axially-protruding resilient finger.

Next, torque is applied, in a closing direction, to the torque ring using the torque-providing device. This results in the axially-protruding resilient finger and the finger aperture engaging to translate torque to the plug. The plug is thereby rotated, in the closing direction, until torque overcomes a resisting force of the axially-protruding resilient finger. When the resisting force is overcome, the axially-protruding resilient finger and the finger aperture disengage such that the torque ring rotates relative to the torque collar. Thus, the amount of torque that can be applied to the plug is limited.

The method can further comprise inserting the plug into a flange disposed within a lid of a container. The method can also include compressing a gasket on the plug against the flange when the plug is rotated in the closing direction to seal the container. Further, the method can insure that damage to gaskets is inhibited and/or prohibited by disengaging the torque ring and the torque collar when the resisting force is overcome.

Additionally, the method can comprises applying torque, in an opening direction, to the torque ring using the torque-providing device. Opening-direction torque can cause the axially-protruding resilient finger and the finger aperture to engage and translate torque to the plug. As such, the plug can rotate in the opening direction until the torque-providing device ceases to apply the torque.

BRIEF DESCRIPTION OF THE DRAWINGS

Embodiments of the invention are disclosed with reference to the accompanying drawings and are for illustrative purposes only. The invention is not limited in its application to the details of construction, or the arrangement of the components, illustrated in the drawings. The invention is capable of other embodiments or of being practiced or carried out in other various ways. Like reference numerals are used to indicate like components.

FIG. 2 illustrates an elevational, cross-sectional view, taken along line 2—2 of FIG. 1, showing a plug with tabs.

FIG. 3 illustrates a top, plan view of the plug of FIG. 2.

DETAILED DESCRIPTION OF THE PREFERRED EMBODIMENTS

Figure 1:
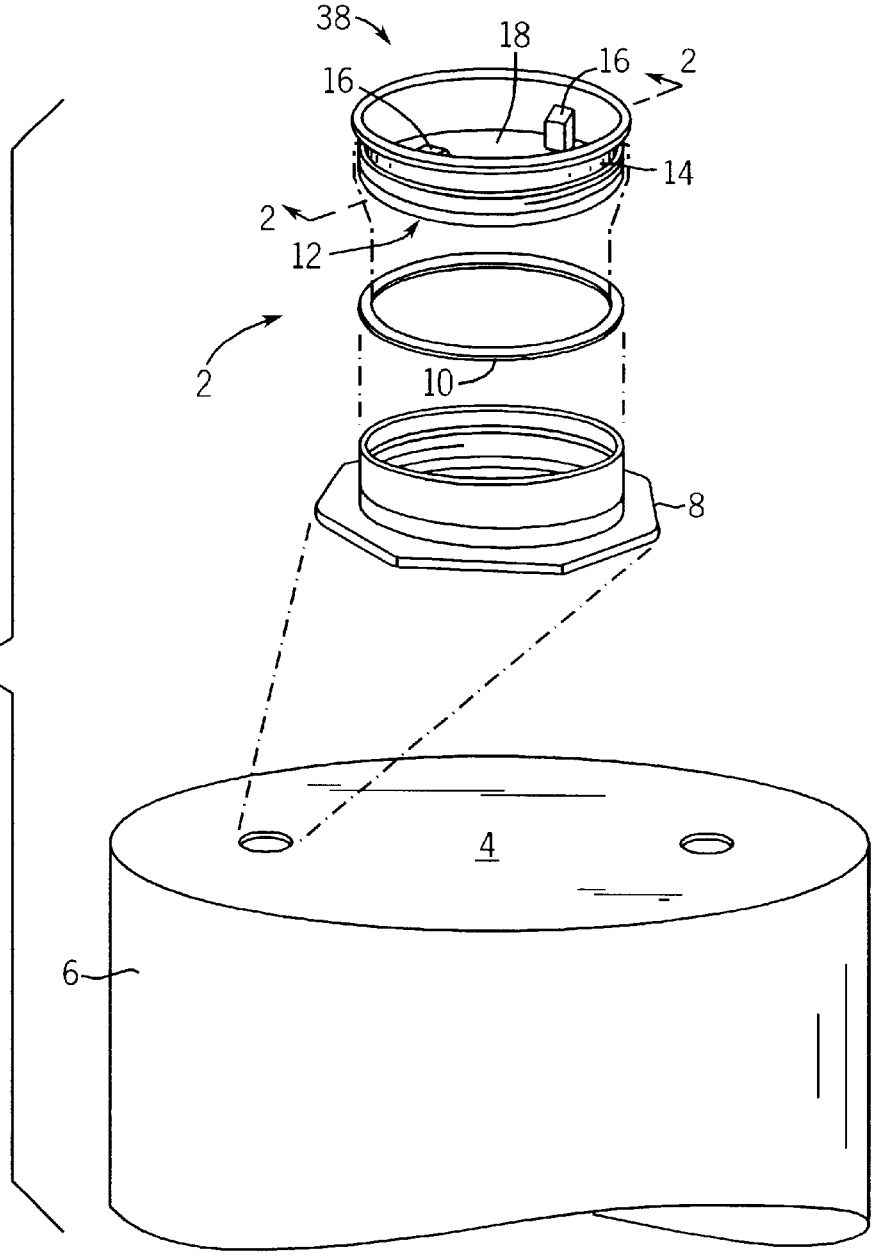
FIG. 1 PRIOR ART
FIG. 1 illustrates an exploded, perspective view of a prior art sealing assembly for use with a container.

Referring to FIG. 1, an exploded view of conventional sealing assembly 2, as known in the art, is illustrated in association with lid 4 of container 6. The typical sealing assembly 2 comprises flange 8, gasket 10, and plug 12.

As known in the art, flange 8 (i.e., a bunghole) typically comprises a circular, threaded member that is crimped or otherwise secured within lid 4 of container 6. One or more flanges 8 can be employed on lid 4, or elsewhere upon container 6, to permit the container to receive and discharge fluids. Often, container 6 will comprise a 55-gallon metal drum containing two differently-sized flanges 8, namely a 2-inch flange and a ¾-inch flange. The 2-inch flange can permit the ingress of one fluid (e.g., water, fuel oil, liquid chemicals) while the ¾-inch flange can concurrently permit the egress of another fluid (e.g., air, other gases). After container 6 is filled, flanges 8 are generally sealed to prepare the container for shipping, transportation, and/or storage. To seal the container 6, it is known in the art to employ sealing assembly 2, as illustrated in FIG. 1, or another like sealing assembly.

In FIG. 1, gasket 10 is illustrated in a typical arrangement within sealing assembly 2. As shown, gasket 10 can be positioned between flange 8 and plug 12. Usually, gasket 10 is received and seated upon flange.8, fitted upon plug 12 proximate a plug periphery 14, or the like. Gasket 10 can be incorporated within, or as a part of, sealing assembly 2 in various arrangements, such arrangements being known in the art. Gasket 10 can be made of rubber, or a like material, which provides the gasket with the ability to form a liquid-impermeable seal between adjacent components (e.g., plug 12 and flange 8), particularly when the gasket is compressed.

As illustrated in FIGS. 2 and 3, plug 12 can comprise a circular, threaded member configured to be threadably received within flange 8. When plug 12 is rotated, the plug can be either drawn toward, or away from, flange 8, depending on the direction of rotation. For example, when plug 12 is rotated in a "closing" direction (e.g., clockwise), the plug is drawn and/or pulled closer to flange 8. Alternatively, when plug 12 is rotated in an "opening" direction (e.g., counter-clockwise), the plug is urged, biased, and/or pushed away from the flange.

Referring back to FIG. 1, if plug 12 receives torque (i.e., a rotational force) in the closing direction, the plug is drawn towards the flange and gasket 10 is compressed between the plug and the flange. As such, gasket 10 can form a seal that inhibits and/or prevents fluid penetration. Similarly, if torque is applied to plug 12 in the opening direction, gasket 10 can be decompressed and thereby release, discharge, and/or terminate the liquid-impermeable seal that inhibits and/or prevents fluid penetration. If rotation in the opening direction continues long enough, plug 12 can be removed, ejected, and/or expelled from flange 8 altogether.

In order to accept torque, plug 12 can be equipped with tabs 16 (i.e., lugs, drive lugs, and the like) as illustrated in FIGS. 1–3. Tabs 16 can comprise one or more pieces of plastic, metal, and/or other like materials secured to, for example, top surface 18 of plug 12. Securement of tabs 16 to plug 12 can be accomplished with spot welds (not shown) or other methods known in the art.

Tabs 16 on plug 12 can be configured to receive and/or engage a multitude of torque-providing devices, such as a wrench, a torque wrench, and/or similar tools (not shown). Engagement of the torque-providing device and tabs 16 facilitates translation and/or transfer of torque from the torque-producing device to plug 12. Thus, the torque-producing device can rotate plug 12 in either the opening or the closing direction. Unfortunately, this system of providing torque, and therefore rotation, to plug 12 is fraught with perils. Therefore, gasket 10 can be over-compressed, under-compressed, damaged, and the like. Thus, sealing assembly 2, which relies on the liquid-impermeable seal being formed by gasket 10, can fail. Failure of sealing assembly 2 and/or gasket 10 allows fluids to escape from container 6. In other words, sealing assembly 2 and/or gasket 10 can be ineffectual and container 6 can leak.

Figure 4:
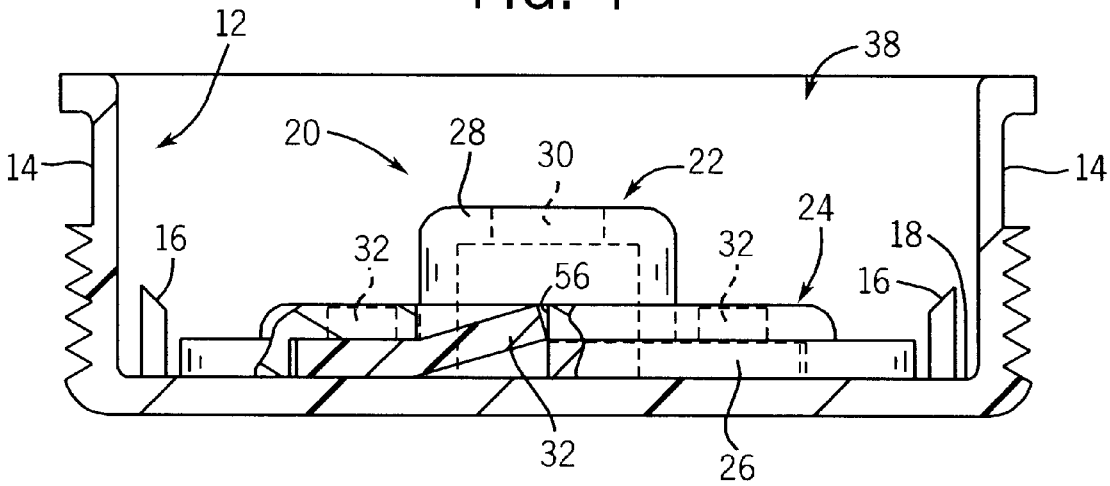
FIG. 4 illustrates an elevational, cross-sectional view of the plug of FIG. 2 employing an embodiment of a torque-limiting apparatus according to the invention.
Figure 5:
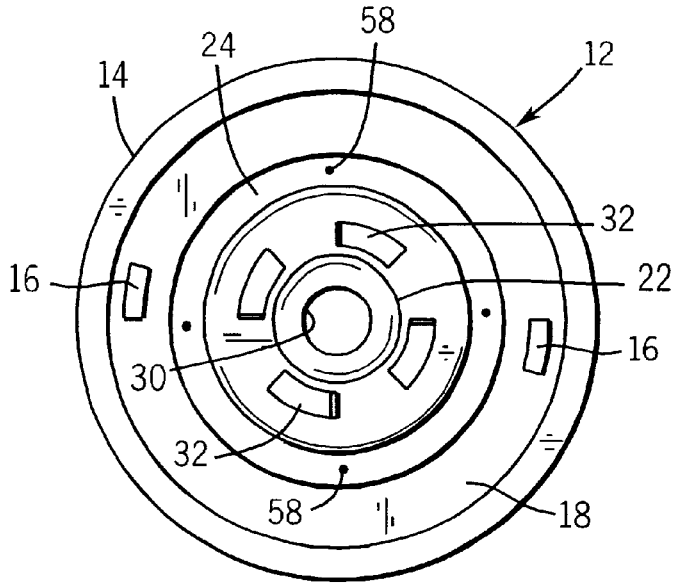
FIG. 5 illustrates a top, plan view of the plug of FIG. 4.
Figure 6:
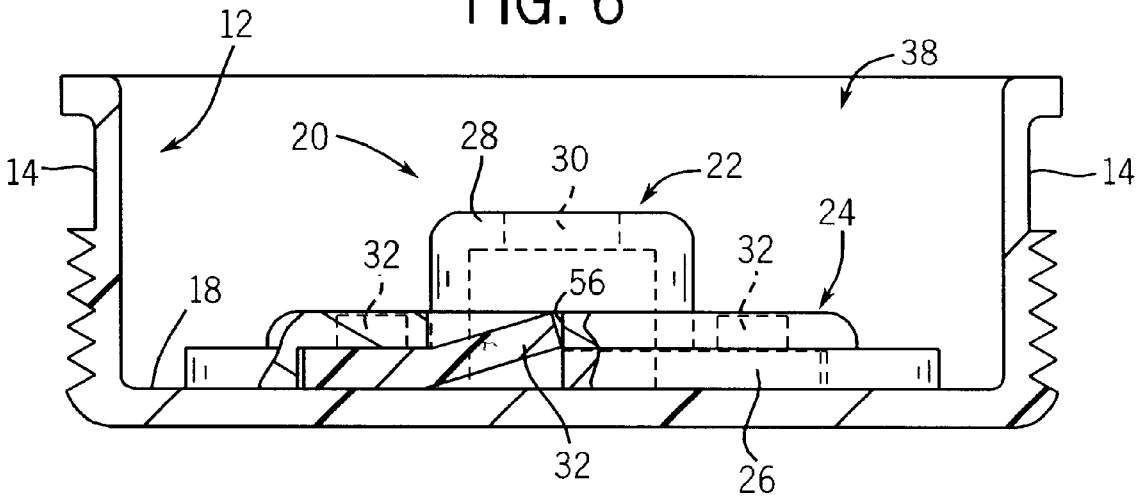
FIG. 6 illustrates an elevational, cross-sectional view of the plug of FIG. 2 employing an embodiment of torque-limiting apparatus according to the invention with the tabs having been removed.
Figure 7:
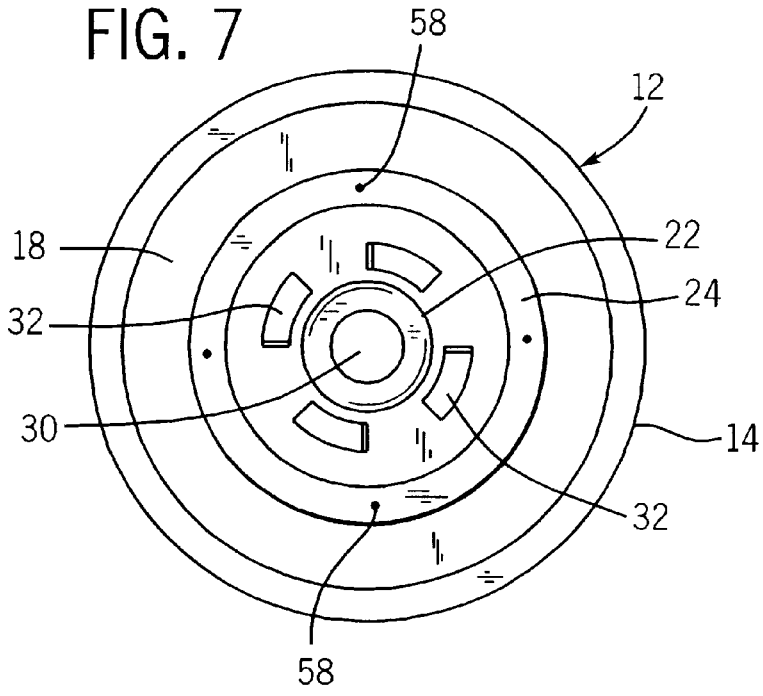
FIG. 7 illustrates a top, plan view of the plug of FIG. 6.

To prevent, inhibit, and/or eliminate over-compressed, under-compressed, damaged, and otherwise ineffectual gaskets and sealing assemblies, a torque-limiting apparatus 20 according to the invention is illustrated in FIGS. 4–7. In FIGS. 4 and 5, an embodiment of torque-limiting apparatus 20 is secured to a conventional plug, such as plug 12 (FIG. 1), while tabs 16 are still secured to and/or disposed on the plug. However, in a preferred embodiment as illustrated in FIGS. 6 and 7, torque-limiting apparatus 20 can be secured to the conventional plug 12 where tabs 16 have been removed and/or otherwise eliminated. In each of these embodiments, torque-limiting apparatus 20 is intended to replace and/or be used in lieu of tabs 16 to provide torque and/or a rotational force to plug 12.

In addition to torque-limiting apparatus 20 being adaptable to conventional plugs 12 and/or capable of being retro-fit (i.e., installed after manufacture) to the conventional plugs as illustrated in FIGS. 4 and 6, the torque-limiting apparatus can also be installed on a newly manufactured plug (not shown). Whether employed on a new or used plug, torque-limiting apparatus 20 can function and/or perform effectively. Thus, torque-limiting apparatus 20 is universally adaptable and/or securable to newly manufactured plugs, previously manufactured plugs, plugs with tabs 16, plugs without the tabs, and the like. In preferred embodiments, torque-limiting apparatus 20 is employed within conventional sealing assembly 2 when plug 12 is a used plug, an existing plug, a re-used plug, an old plug, and/or a recycled plug.

As shown in FIGS. 4–7, torque-limiting apparatus 20 comprises torque ring 22 and torque collar 24. Torque ring 22 and torque collar 24 can each be manufactured from a variety of materials such as metal, metal alloys, plastic, and the like. In preferred embodiments, torque ring 22 and/or torque collar 24 are constructed of stainless steel.

Figure 8:
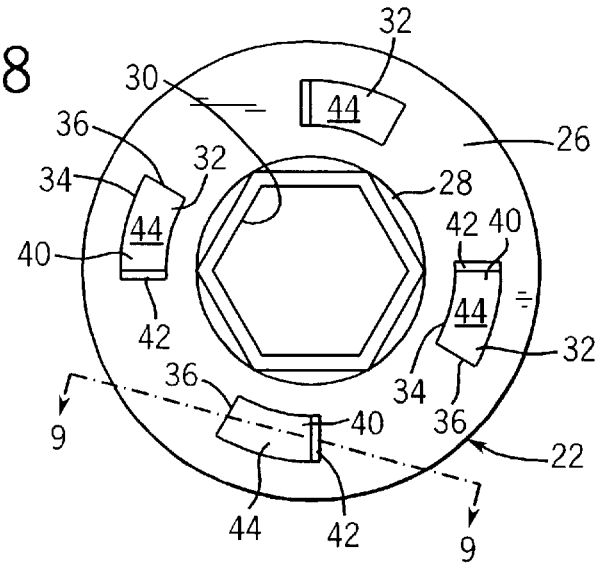
FIG. 8 illustrates a top, plan view of a torque ring within the torque-limiting apparatus of FIGS. 4 and 6.
Figure 9:
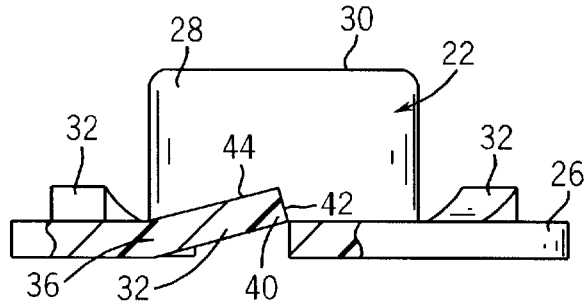
FIG. 9 illustrates a elevational, cross-sectional view of the torque ring of FIG. 8 taken along line 9—9.

In a preferred embodiment, as illustrated in detail in FIGS. 8 and 9, torque ring 22 comprises a circular, metal member having flange portion 26 and raised, central portion 28. Central portion 28, when viewed from above (FIG. 8), can be round, square, hexagonal, octagonal, or similarly shaped. Further, central portion 28 can include torque ring aperture 30 which is designed and configured to receive the torque-providing device (not shown). Torque ring aperture 30, when viewed from above (FIG. 8), can be also be round, square, hexagonal, octagonal, or similarly shaped. Torque ring aperture 30 is capable of complimenting, through engagement, the host of possible torque-providing devices available. It is also contemplated that torque ring aperture 30 can be adjustable to provide wide-ranging acceptance of available torque-providing devices.

Still referring to FIGS. 8 and 9, flange portion 26 can include one or more axially-protruding, resilient fingers 32 (i.e., coupling members, ratchet teeth, extensions, protrusions, and the like). Each finger 32 can be formed by making incisions within torque ring 22 along a periphery 34 of each finger and thereafter vertically elevating, axially raising, and/or upwardly bending the finger at vertex end 36. As used herein, "upward" and "upwardly" are defined as being toward plug opening 38 and/or away from top surface 18 when torque-limiting apparatus 20 is secured to plug 12 as illustrated in FIGS. 4 and 6. Similarly, as used herein, "downward" and "downwardly" are defined as being away from plug opening 38 and/or towards top surface 18 when torque-limiting apparatus 20 is secured to plug 12 as illustrated in FIGS. 4 and 6.

When finger 32 is bent upwardly and/or protrudes from torque ring 22, salient end 40 of the finger is extracted from torque ring 22 and becomes exposed as illustrated in FIG. 9. Exposure of finger 32 from within torque ring 22 creates and/or defines a front surface 42 and a friction surface 44.

In a preferred embodiment, after upwardly bending finger 32, the finger maintains the upwardly-bent position. However, despite being upwardly disposed, finger 32 remains flexible and, furthermore, resilient. As such, finger 32 can be biased downwardly upon the application of a downward and/or radial force, yet return to the upwardly-bent configuration when the downward and/or radial force is removed. For example, upon the application of sufficient downward and/or radial force, finger 32 can flexibly retreat back to the original, "un-bent" or flush position within torque ring 22. Thereafter, upon removal of the downward and/or radial force, finger 32 is capable of"springing back" to the upwardly-bent position as illustrated in FIG. 9.

In an exemplary embodiment, torque ring 22, and/or particularly finger 32, can be hardened, flexibly stiffened, made resilient and/or otherwise treated to ensure that the finger possess a resilient, "spring-like" property which will encourage the finger to remain upwardly (i.e., axially) biased. Because finger 32 is resilient, the finger is capable of withstanding shock without permanent deformation and will tend to recover from, or adjust to, misfortune and/or change. Therefore, finger 32 can have the ability to recover size and/or shape after deformation caused by stress, and especially compressive stress. Such methods of treating metal and/or other substances to provide resiliency, for example through chemical and/or thermal exposure, are well known and contemplated.

Figure 10:
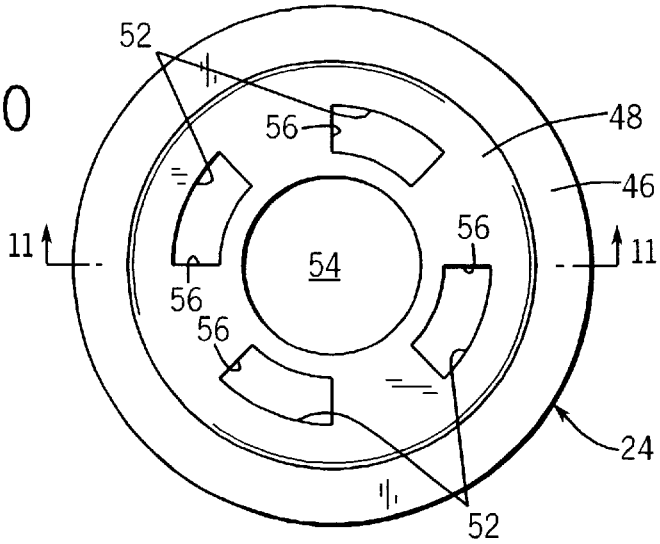
FIG. 10 illustrates a top, plan view of a torque collar within the torque-limiting apparatus of FIGS. 4 and 6.
Figure 11:
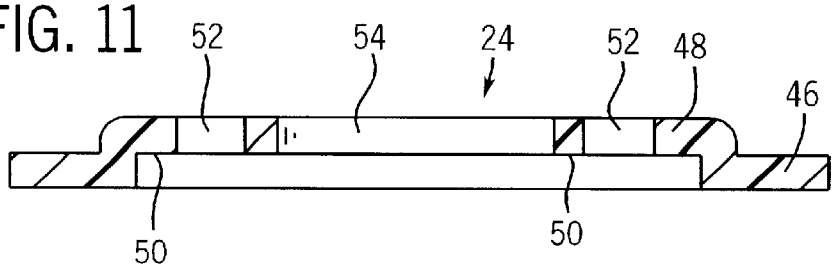
FIG. 11 illustrates a elevational, cross-sectional view of the torque collar of FIG. 10 taken along line 11—11.

Torque collar 24 presents a circular, metal member having flange portion 46, raised, central portion 48, and lower surface 50. Disposed within central portion 48 are one or more finger apertures 52 and torque collar aperture 54. Each finger aperture 52, which extends entirely through torque collar 24, includes and defines camming surface 56 as illustrated in FIGS. 4, 6, and 10. Torque collar aperture 54 is designed and configured to receive central portion 28 of torque ring 22. As such, torque collar aperture 54 can be round, square, hexagonal, octagonal, or similarly shaped to correspond to the shape of central portion 28.

Finger apertures 52 are designed and configured to receive and engage fingers 32. As such, in preferred embodiments, the number of finger apertures 48 within torque collar 24 agrees with and/or corresponds to the number of fingers 32 on torque ring 22. For example, as illustrated in FIGS. 8 and 10, four fingers 32 and four finger apertures 52 are shown. However, it is contemplated that one or more fingers 32, as well as one or more finger apertures 48, can be used. Furthermore, there is no requirement that the number of fingers 32 correspond to the number of finger apertures 48 although such an arrangement can be preferred.

Referring back to FIGS. 4 and 6, in a preferred embodiment torque-limiting apparatus 20 is assembled and/or constructed when torque collar 24 is disposed upon torque ring 22. As shown, central portion 28 of torque ring 22 is received by torque collar aperture 54 in torque collar 24. In this mating arrangement, central portion 28 is placed within, and upwardly protrudes from, collar aperture 54. At the same time, any fingers 32 on torque ring 22 are received by finger apertures 52 in torque collar 24. Thus, fingers 32 are placed within, and upwardly protrude into, corresponding finger apertures 52. As assembled, torque ring 22 would be free to rotate underneath torque collar 24 if not for the impediment produced by the engagement of fingers 32 and finger apertures 52.

After torque collar 24 has been mounted on torque ring 22, torque-limiting apparatus 20 can be secured to plug 12 (or a new plug). As illustrated in FIGS. 5 and 7, securement can be performed by forming one or welds 58 between torque collar 24 and plug 12. In preferred embodiments, welds 58 are formed at, or upon, flange portion 46 of torque collar 24. As such, torque collar 24 is directly connected to plug 12. Conversely, torque ring 22 is only indirectly connected to plug 12 by the interaction of torque collar 24 with torque ring 22 and/or fingers 32 with finger apertures 52.

Figure 12:
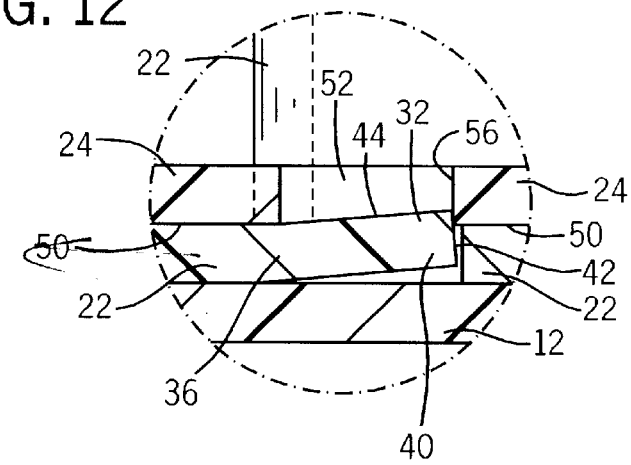
FIG. 12 illustrates a side, elevational view of a portion of the torque-limiting apparatus from FIG. 6 which highlights engagement of an axially-protruding resilient finger and a finger aperture when torque is applied in a closing direction.

In operation, plug 12 can employ torque-limiting apparatus 20 as shown in FIGS. 4 and 6 and can be disposed within, for example, sealing assembly 2 (FIG. 1). In such an arrangement, plug 12 can begin to be threadably inserted into flange 8. Thereafter, the torque-providing device (not shown) can be inserted into and/or received by torque ring aperture 30. If torque is supplied in the closing direction by the torque-providing device, torque ring 22 will correspondingly attempt to, be encouraged to, and/or begin to rotate in the closing direction. As shown in FIG. 12, when torque ring 22 begins to rotate in the closing direction, friction surface 44, provided by finger 32, engages torque collar 24, particularly at lower surface 54. Such engagement can permit the finger 32 to generate and/or produce a resisting force that, for the most part, opposes the torque applied in the closing direction.

In one embodiment, the resisting force can be comprised of friction when, for example, friction surface of finger 32 and lower surface 54 of finger aperture 52 (i.e., torque ring 22 and torque collar 24) abrade against each other. In another embodiment, the resisting force can be comprised of shear resistance generated by the upwardly (i.e., axially) protruding finger abutting the torque collar. In yet another embodiment, the resisting force can be comprised of both friction and shear resistance by combining both of the above embodiments.

To adjust the resisting force, the resiliency of finger 32 can be increased or decreased, friction surface 44 of finger 32 can be altered, lower surface 54 of torque collar 24 can be altered, additional fingers 32 can be added to torque ring 22, and the like. Such actions will either increase or decrease the magnitude of the resisting force. By varying these properties, the engagement of finger 32 and finger aperture 52 can be consequently prolonged or diminished.

Since the resisting force holds finger 32 and finger aperture 52 (i.e., torque ring 22 and torque collar 24) in engagement, the torque applied to the torque ring in the closing direction is translated from the torque ring to the torque collar. In turn, since torque collar 24 is secured to plug 12, the torque is thereafter translated from the torque collar to the plug 12. As such, plug 12 can be rotated in the closing direction by application of torque to torque ring 22.

If plug 12, using torque-limiting apparatus 20, is part of sealing assembly 2 (FIG. 1), rotation of the plug in the closing direction can cause the plug to be drawn toward flange 8. As the rotation continues, plug 12 can compress gasket 10 against flange 8. Thus, gasket 10 is capable of forming a liquid-impermeable seal. However, as noted above, if gasket 10 is too forcefully compressed, or insufficiently compressed, container 6 can leak. Therefore, torque-limiting apparatus 20 is designed to provide an "appropriate" amount of torque by disengaging when the appropriate amount of torque has been administered and/or achieved. When torque-limiting apparatus disengages, no further torque is supplied to plug 12 and further compression of gasket 10 ceases.

The "appropriate" torque can be defined as that amount of torque that causes disengagement of finger 32 and finger aperture 52, that amount of torque that inhibits and/or prevents damage to gasket 10, that amount of torque that permits gasket 10 to form the liquid-impermeable seal between plug 12 and flange 8, or that amount of torque that inhibits and/or prevents container 6 from leaking.

Figure 13:
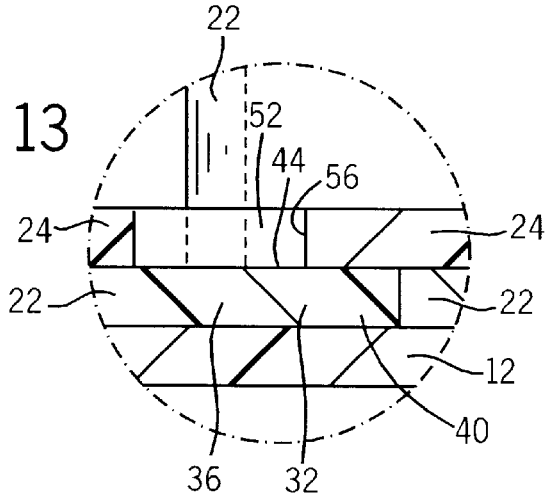
FIG. 13 illustrates a side, elevational view of the portion of the torque-limiting apparatus from FIG. 6 which highlights disengagement of the axially-protruding resilient finger and the finger aperture when a resisting force is overcome by the applied torque.

For torque-limiting apparatus to disengage, the torque applied in the closing direction overcomes and/or exceeds the resisting force. When the resisting force succumbs to the superiority of the torque, finger 32 is temporarily biased downwardly and/or radially by finger aperture 52 and/or lower surface 54 as illustrated in FIG. 13. In other words, finger 32 can be biased toward plug 12, biased away from torque collar 24, flattened by the torque collar, and/or bent flush with torque ring 22. The downward and/or radial pressure causes finger 32 to be displaced from the upwardly-bent, protruding position. Therefore, finger 32 can be persuaded to retreat within torque ring 22 until friction surface 44 becomes flush with torque ring 22 as depicted in FIG. 13.

When finger 32 achieves the position illustrated in FIG. 13, torque ring 22 no longer drives torque collar 24 and plug 12. With plug 12 idled, compression of gasket 10 halts. Therefore, during disengagement, torque ring 22 is capable of rotating, at least temporarily, underneath torque collar 24. Since torque-limiting apparatus 20 discontinues providing torque to plug 12 upon disengaging at the "appropriate" torque, over-compressing, under-compressing, and/or damaging of gasket 10 is discouraged and/or avoided altogether. Thus, torque-limiting apparatus 20 ensures, by disengaging at the "appropriate" torque, that the liquid-impermeable seal will be formed and container 6 will not leak.

Because the appropriate amount of torque and the resisting force directly correspond to each other, the resisting force can adjusted to correspondingly adjust the appropriate torque applied to plug 12. When the appropriate amount of torque is adjusted, the point at which torque-limiting apparatus 20 disengages can be altered and/or changed. Thus, the amount of torque applied to plug 12, which compresses gasket 10, can be modified and/or varied as desired.

Additionally, the amount of compression experienced by gasket 10 can be adapted and/or adjusted to suit various container sealing conditions (e.g., where the gasket is composed of variable materials, where the gasket is compressed at different temperatures, where the fluid being contained is pressurized, etc.).

Notably, the torque-limiting benefit bestowed upon plug 12 by torque-limiting apparatus 20 is provided without the need or requirement for an independent, helical compression spring or other distinct, independent "spring-like" component. The axially-protruding, resilient fingers 32 are integrated and/or incorporated directly within torque ring 22.

After disengagement occurs as shown in FIG. 13, if torque ring 22 rotates beneath torque collar 24 far enough, finger 32 on the torque ring will once more encounter finger aperture 52 (or another finger aperture) and can become engaged with the finger aperture as shown in FIG. 12. When this "re-engagement" takes place, finger 32 springs upwardly within finger aperture 52 and resiliently resumes the upwardly-bent position.

In addition to preventing over-compression of gasket 10, torque-limiting apparatus 20 discourages under-compressing the gasket as well. Until the appropriate amount of torque has been administered to torque ring 22, and resultantly torque collar 24 and plug 12, the torque ring and the torque collar remain engaged due to the resisting force. While engagement continues, torque and rotation in the closing direction persist, thereby causing gasket 10 to be increasingly compressed. Thus, torque-limiting apparatus can simultaneously and/or concurrently cope with both the problem of over-compression and under-compression of gasket 10.

Figure 14:
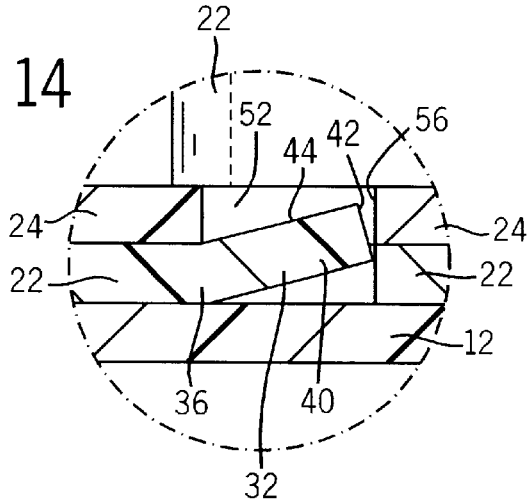
FIG. 14 illustrates a side, elevational view of the portion of the torque-limiting apparatus from FIG. 6 which highlights engagement of the axially-protruding resilient finger and the finger aperture when torque in applied an opening direction.

As illustrated in FIG. 14, in addition to rotating plug 12 in the closing direction, torque-limiting apparatus 20 can also rotate the plug in an opening direction. In fact, rotation in the opening direction and rotation in the closing direction are generally performed by the same pair of components, namely finger 32 and finger aperture 52. However, engagement of finger 32 with finger aperture 52 during rotation in an opening direction is unique.

The torque-providing device (not shown) can be inserted into and/or received by torque ring aperture 30. If torque is supplied in the opening direction by the torque-providing device, torque ring 22 will correspondingly attempt to, be encouraged to, and/or begin to rotate in the opening direction. As shown in FIG. 14, when torque ring 22 begins to rotate in the opening direction, front surface 42, provided by finger 32, engages torque collar 24, particularly at camming surface 56. The engagement of front surface 42 and camming surface 56 causes the torque applied in the opening direction to be translated from torque ring 22 to torque collar 24. Since torque collar 24 is secured to plug 12, the torque experienced by the torque collar is supplied to plug 12. Thus, engagement of finger 32 with finger aperture 42, and particularly front surface 42 and camming surface 56, allows torque to be indirectly distributed from torque ring 22 to plug 12. As such, plug 12 can be rotated in the opening direction and biased and/or pushed away from flange 8, thereby decompressing gasket 10.

Plug 12 can be threadably loosened, removed from container 6, and thereafter reused. Thus, plug 12 can beneficially be inserted and removed from container 6 as many times as desired. Such reuse does not damage plug 12, container 6, or any other component associated with sealing assembly 2.

Also, even though a cap seal (i.e., a safety seal) may not be necessary to prevent container 6 from leaking, torque-limiting apparatus 20, as secured to plug 12, does not interfere with the later attachment of such a cap seal. This can be of consequence if municipal, county, state, and/or government regulations, or the like, require and/or encourage the use of cap seals to augment or further guarantee protection from leaks.

Despite any methods being outlined in a step-by-step sequence, the completion of acts or steps in a particular chronological order is not mandatory. Further, elimination, modification, rearrangement, combination, reordering, or the like, of acts or steps is contemplated and considered within the scope of the description and claims.

While the present invention has been described in terms of the preferred embodiment, it is recognized that equivalents, alternatives, and modifications, aside from those expressly stated, are possible and within the scope of the appending claims.

What is claimed is:

1. An apparatus for limiting torque applied by a torque-providing device, the apparatus comprising:

a torque ring rotatably seatable upon a plug, the torque ring having:

a torque ring aperture capable of engaging the torque-providing device; and an axially-protruding resilient finger providing a resisting force;

a torque collar securable to the plug and holding the torque ring rotatably captive, the torque collar having:

a torque collar aperture capable of receiving the torque-providing device; and a finger aperture capable of receiving and engaging the axially-protruding resilient finger;

wherein, when the torque is applied to the torque ring by the torque-providing device in a closing direction, the axially-protruding resilient finger engages the finger aperture to transfer the torque from the torque ring to the torque collar, permitting the torque collar to rotate the plug in the closing direction until the torque overcomes the resisting force of the axially-protruding resilient finger, whereupon the axially-protruding resilient finger disengages from the finger aperture, resulting in the torque ring continuing to rotate in the closing direction independent of the torque collar and the plug.

2. The apparatus of claim 1, wherein the disengagement permits the torque ring to continue rotating in the closing direction beneath the torque collar.

3. The apparatus of claim 1, wherein the disengagement permits the torque ring to continue rotating in the closing direction apart from the torque collar and the plug.

4. The apparatus of claim 1, wherein the disengagement permits the torque ring to continue rotating in the closing direction relative to the torque collar and the plug, and further permits the torque collar and the plug remaining stationary.

5. The apparatus of claim 1, wherein the disengagement occurs when the axially-protruding resilient finger is one of biased toward the plug, biased away from the torque collar, flattened by the torque collar, forced axially downwardly, radially urged downwardly, and bent flush with the torque ring.

6. The apparatus of claim 1, wherein the disengagement occurs as the axially-protruding resilient finger is temporarily deformed such that it is not axially-protruding from the torque ring.

7. The apparatus of claim 1, wherein the disengagement ensures that a gasket, used in conjunction with the plug, is not damaged.

8. The apparatus of claim 1, wherein the rotation in the closing direction is permitted to continue until the axially-protruding resilient finger once again engages with the finger aperture.

9. The apparatus of claim 1, wherein the rotation in the closing direction permits the plug to be sealably inserted within a container.

10. The apparatus of claim 9, wherein the plug can be removed from being sealably inserted within the container without damage occurring to the plug.

11. The apparatus of claim 1, wherein the resisting force is determined by friction generated between the axially-protruding resilient finger and the torque collar.

12. The apparatus of claim 1, wherein the resisting force is determined by upward protrusion of the axially-protruding resilient finger and friction generated between the axially-protruding resilient finger and the torque collar.

13. The apparatus of claim 1, wherein the resisting force is overcome before a gasket used with the plug is damaged.

14. The apparatus of claim 1, wherein the resisting force inhibits or prevents damage to a gasket used with the plug.

15. The apparatus of claim 1, wherein the plug accepts a gasket about a plug periphery and the gasket is compressed against a container by the rotation in the closing direction, thereby temporarily sealing the container.

16. The apparatus of claim 1, wherein the torque ring aperture is adjustable to compliment the torque-providing device.

17. The apparatus of claim 1, wherein the apparatus eliminates human error by automatically disengaging when the torque applied to the torque ring overcomes the resisting force.

18. The apparatus of claim 1, wherein the plug is one of a used plug, a re-used plug, an existing plug, an old plug, and a recycled plug.

19. A retrofit apparatus for limiting torque that is applied by a torque-providing device to a used plug, the apparatus comprising:

a torque ring rotatably seatable upon the used plug, the torque ring having:

a torque ring aperture capable of engaging the torque-providing device; and an axially-protruding resilient finger providing a resisting force;

a torque collar securable to the used plug and holding the torque ring rotatably captive, the torque collar having:

a torque collar aperture capable of receiving the torque-providing device; and a finger aperture capable of receiving and engaging the axially-protruding resilient finger;

wherein, when the torque is applied to the torque ring by the torque-providing device in a closing direction, the axially-protruding resilient finger engages the finger aperture to transfer the torque from the torque ring to the torque collar, permitting the torque collar to rotate the used plug in the closing direction until the torque overcomes the resisting force of the axially-protruding resilient finger, whereupon the axially-protruding resilient finger disengages from the finger aperture, resulting in the torque ring continuing to rotate in the closing direction independent of the torque collar and the used plug.

20. An apparatus for limiting torque applied by a torque-providing device, the apparatus comprising:

a torque ring rotatably seatable upon a plug, the torque ring having:

a torque ring aperture capable of engaging the torque-providing device; and an axially-protruding resilient finger providing a resisting force;

a torque collar securable to the plug and holding the torque ring rotatably captive, the torque collar having:

a torque collar aperture capable of receiving the torque-providing device; and a finger aperture capable of receiving and engaging the axially-protruding resilient finger;

wherein, when the torque is applied to the torque ring by the torque-providing device in an opening direction, the axially-protruding resilient finger engages the finger aperture to transfer the torque from the torque ring to the torque collar, permitting the torque collar to rotate the plug in the opening direction until the torque is no longer applied by the torque-providing device; and wherein, when the torque is applied to the torque ring by the torque-providing device in a closing direction, the axially-protruding resilient finger engages the finger aperture to transfer the torque from the torque ring to the torque collar, permitting the torque collar to rotate the plug in the closing direction until the torque overcomes the resisting force of the axially-protruding resilient finger, whereupon the axially-protruding resilient finger disengages from the finger aperture, resulting in the torque ring continuing to rotate in the closing direction independent of the torque collar and the plug.

21. The apparatus of claim 20, wherein the plug can seal a container and subsequently be removed from the container without damaging the apparatus.

22. The apparatus of claim 20, wherein the plug is re-usable.

23. The apparatus of claim 20, wherein the plug can be removed from a flange of one container and inserted within a flange of a second container to seal the second container.

24. The apparatus of claim 20, wherein the torque ring comprises a plurality of fingers to increase the resisting force of the torque ring.

25. The apparatus of claim 20, wherein the resisting force is adjusted by increasing or decreasing resiliency of the finger.

26. An apparatus for limiting torque applied by a torque-providing device, the apparatus comprising:

a torque ring rotatably seatable upon a plug, the torque ring having:

a torque ring aperture capable of engaging the torque-providing device; and an axially-protruding resilient finger providing a resisting force;

a torque collar securable to the plug and holding the torque ring rotatably captive, the torque collar having:

a torque collar aperture capable of receiving the torque-providing device; and a finger aperture capable of receiving and engaging the axially-protruding resilient finger;

wherein, when the torque is applied to the torque ring by the torque-providing device in an opening direction, the axially-protruding resilient finger engages the finger aperture to transfer the torque from the torque ring to the torque collar, permitting the torque collar to rotate the plug in the opening direction until the torque is no longer applied by the torque-providing device; and wherein, when the torque is applied to the torque ring by the torque-providing device in a closing direction, the axially-protruding resilient finger engages the finger aperture to transfer the torque from the torque ring to the torque collar, permitting the torque collar to rotate the plug in the closing direction until the torque overcomes the resisting force of the axially-protruding resilient finger, whereupon the axially-protruding resilient finger disengages from the finger aperture, resulting in the torque ring continuing to rotate in the closing direction independent of the torque collar and the plug such that the torque applied to the plug in the closing direction is limited.

27. An apparatus for limiting torque applied by a torque-providing device, the apparatus comprising:

a torque ring rotatably seatable upon a plug, the torque ring having:

a torque ring aperture capable of engaging a torque-providing device; and an axially-protruding resilient finger having a front surface and a friction surface, the friction surface providing a resisting force;

a torque collar having a sliding surface, the torque collar securable to the plug and holding the torque ring rotatably captive, the torque collar having:

a torque collar aperture capable of receiving the torque-providing device; and a finger aperture having a camming surface, the finger aperture capable of receiving and engaging the axially-protruding resilient finger;

wherein, when the torque is applied to the torque ring by the torque-providing device in an opening direction, the front surface of the axially-protruding resilient finger engages the camming surface of the finger aperture to transfer the torque from the torque ring to the torque collar, permitting the torque collar to rotate the plug in the opening direction until the torque is no longer applied by the torque-providing device; and wherein, when the torque is applied to the torque ring by the torque-providing device in a closing direction, the friction surface of the axially-protruding resilient finger engages the sliding surface of the finger aperture to transfer the torque from the torque ring to the torque collar, permitting the torque collar to rotate the plug in the closing direction until the torque overcomes the resisting force provided by the friction surface of the axially-protruding resilient finger, whereupon the friction surface of the axially-protruding resilient finger disengages from the sliding surface of the finger aperture, resulting in the torque ring continuing to rotate in the closing direction independent of the torque collar and the plug such that the torque applied to the plug in the closing direction is limited.

28. The apparatus of claim 27, wherein the friction surface of the axially-protruding resilient finger is varied to increase or decrease the resisting force of the resilient finger.

29. The apparatus of claim 27, where the resiliency of the axially-protruding resilient finger is varied to increase or decrease the resisting force of the resilient finger.

30. An apparatus for limiting torque applied by a torque-providing device, the apparatus comprising:

a torque ring rotatably seatable upon a plug, the torque ring having:

a torque ring aperture capable of engaging a torque-providing device; and an axially-protruding resilient finger having a front surface and a friction surface, the friction surface providing a portion of a resisting force;

a torque collar having a sliding surface, the sliding surface providing a portion of the resisting force, the torque collar securable to the plug and holding the torque ring rotatably captive, the torque collar having:

a torque collar aperture capable of receiving the torque-providing device; and a finger aperture having a camming surface, the finger aperture capable of receiving and engaging the axially-protruding resilient finger;

wherein, when the torque is applied to the torque ring by the torque-providing device in an opening direction, the front surface of the axially-protruding resilient finger engages the camming surface of the finger aperture to transfer the torque from the torque ring to the torque collar, permitting the torque collar to rotate the plug in the opening direction until the torque is no longer applied by the torque-providing device; and wherein, when the torque is applied to the torque ring by the torque-providing device in a closing direction, the friction surface of the axially-protruding resilient finger engages the sliding surface of the finger aperture to transfer the torque from the torque ring to the torque collar, permitting the torque collar to rotate the plug in the closing direction until the torque overcomes the resisting force provided by the friction surface of the axially-protruding resilient finger and the sliding surface of the torque collar, whereupon the friction surface of the axially-protruding resilient finger disengages from the sliding surface of the finger aperture, resulting in the torque ring continuing to rotate in the closing direction independent of the torque collar and the plug such that the torque applied to the plug in the closing direction is limited.

31. An apparatus, which is retro-fit upon a used plug, for limiting torque applied by a torque-providing device, the apparatus comprising:

a torque ring rotatably seatable upon a used plug, the torque ring having:

a torque ring aperture capable of engaging a torque-providing device; and an axially-protruding resilient finger having a front surface and a friction surface, the friction surface providing a portion of a resisting force;

a torque collar having a sliding surface, the sliding surface providing a portion of the resisting force, the torque collar securable to the used plug and holding the torque ring rotatably captive, the torque collar having:

a torque collar aperture capable of receiving the torque-providing device; and a finger aperture having a camming surface, the finger aperture capable of receiving and engaging the axially-protruding resilient finger;

wherein, when the torque is applied to the torque ring by the torque-providing device in an opening direction, the front surface of the axially-protruding resilient finger engages the camming surface of the finger aperture to transfer the torque from the torque ring to the torque collar, permitting the torque collar to rotate the used plug in the opening direction until the torque is no longer applied by the torque-providing device; and wherein, when the torque is applied to the torque ring by the torque-providing device in a closing direction, the friction surface of the axially-protruding resilient finger engages the sliding surface of the finger aperture to transfer the torque from the torque ring to the torque collar, permitting the torque collar to rotate the used plug in the closing direction until the torque overcomes the resisting force provided by the friction surface of the axially-protruding resilient finger and the sliding surface of the torque collar, whereupon the friction surface of the axially-protruding resilient finger disengages from the sliding surface of the finger aperture, resulting in the torque ring continuing to rotate in the closing direction independent of the torque collar and the used plug such that the torque applied to the used plug in the closing direction is limited.

32. An assembly for limiting torque applied by a torque-providing device, the assembly comprising a plug having a periphery;

a gasket disposed upon the plug proximate the periphery; and an apparatus secured to the plug, the apparatus comprising:

a torque ring rotatably seatable upon the plug, the torque ring having a torque ring aperture capable of engaging the torque-providing device and an axially-protruding resilient finger providing a resisting force; and a torque collar securable to the plug and holding the torque ring rotatably captive, the torque collar having a torque collar aperture capable of receiving the torque-providing device and a finger aperture capable of receiving and engaging the axially-protruding resilient finger;

wherein, when the torque is applied to the torque ring by the torque-providing device in an opening direction, the axially-protruding resilient finger engages the finger aperture to transfer the torque from the torque ring to the torque collar, permitting the torque collar to rotate the plug in the opening direction until the torque is no longer applied by the torque-providing device; and wherein, when the torque is applied to the torque ring by the torque-providing device in a closing direction, the axially-protruding resilient finger engages the finger aperture to transfer the torque from the torque ring to the torque collar, permitting the torque collar to rotate the plug in the closing direction, thereby compressing the gasket, until the torque overcomes the resisting force of the axially-protruding resilient finger, whereupon the axially-protruding resilient finger it disengages from the finger aperture, resulting in the torque ring continuing to rotate in the closing direction independent of the torque collar and the plug such that the torque applied to the plug in the closing direction is limited and the compressed gasket is not damaged.

33. The assembly of claim 32, wherein the plug, the gasket, and the apparatus are offered in a kit.

34. The assembly of claim 32, wherein the apparatus is secured to one of a used plug, a re-used plug, an existing plug, an old plug, and a recycled plug.

35. An assembly for limiting torque applied by a torque-providing device, the assembly comprising a plug having a periphery;

a gasket disposed upon the plug proximate the periphery; and an apparatus secured to the plug, the apparatus comprising:

a torque ring rotatably seatable upon the plug, the torque ring having a torque ring aperture capable of engaging the torque-providing device and an axially-protruding resilient finger providing a resisting force; and a torque collar securable to the plug and holding the torque ring rotatably captive, the torque collar having a torque collar aperture capable of receiving the torque-providing device and a finger aperture capable of receiving and engaging the axially-protruding resilient finger;

wherein, when the torque is applied to the torque ring by the torque-providing device in an opening direction, the axially-protruding resilient finger engages the finger aperture to transfer the torque from the torque ring to the torque collar, permitting the torque collar to rotate the plug in the opening direction until the torque is no longer applied by the torque-providing device; and wherein, when the torque is applied to the torque ring by the torque-providing device in a closing direction, the axially-protruding resilient finger engages the finger aperture to transfer the torque from the torque ring to the torque collar, permitting the torque collar to rotate the plug in the closing direction, thereby compressing the gasket to seal a container, until the torque overcomes the resisting force of the axially-protruding resilient finger, whereupon the axially-protruding resilient finger disengages from the finger aperture, resulting in the torque ring continuing to rotate in the closing direction independent of the torque collar and the plug such that the torque applied to the plug in the closing direction is limited, the compressed gasket is not damaged, and the container does not leak.

36. An assembly for sealing a container, the assembly comprising:

a plug having a periphery;

a gasket disposed upon the plug proximate the periphery;

a flange for threadably receiving the plug having the gasket disposed thereon, the flange in combination with the plug capable of compressing the gasket to seal the container; and a torque-limiting apparatus comprising:

a torque ring rotatably seatable upon the plug, the torque ring having a torque ring aperture capable of engaging a torque-providing device and an axially-protruding resilient finger providing a resisting force; and a torque collar securable to the plug and holding the torque ring rotatably captive, the torque collar having a torque collar aperture capable of receiving the torque-providing device and a finger aperture capable of receiving and engaging the axially-protruding resilient finger;

wherein, when the torque is applied to the torque ring by the torque-providing device in an opening direction, the axially-protruding resilient finger engages the finger aperture to transfer the torque from the torque ring to the torque collar, permitting the torque collar to rotate the plug in the opening direction until the torque is no longer applied by the torque-providing-device, the plug thereby rotatably extractable from within the flange; and wherein, when the torque is applied to the torque ring by the torque-providing device in a closing direction, the axially-protruding resilient finger engages the finger aperture to transfer the torque from the torque ring to the torque collar, permitting the torque collar to rotate the plug in the closing direction, thereby compressing the gasket, until the torque overcomes the resisting force of the axially-protruding resilient finger, whereupon the axially-protruding resilient finger disengages from the finger aperture, resulting in the torque ring continuing to rotate in the closing direction independent of the torque collar and the plug such that the torque applied to the plug in the closing direction is limited and the container is sealed.

37. A system for sealing, the system comprising:

a plug having a periphery;

a gasket disposed upon the plug proximate the periphery;

a container comprising a flange for threadably receiving the plug having the gasket disposed thereon, the flange in conjunction with the plug being capable of compressing the gasket to thereby seal the container; and a torque-limiting apparatus comprising:

a torque ring rotatably seatable upon the plug, the torque ring having a torque ring aperture capable of engaging a torque-providing device and an axially-protruding resilient finger providing a resisting force; and a torque collar securable to the plug and holding the torque ring rotatably captive, the torque collar having a torque collar aperture capable of receiving the torque-providing device and a finger aperture capable of receiving and engaging the axially-protruding resilient finger;

wherein when the torque is applied to the torque ring by the torque-providing device in an opening direction the axially-protruding resilient finger engages the finger aperture to transfer the torque from the torque ring to the torque collar permitting the torque collar to rotate the plug in the opening direction until the torque is no longer applied by the torque-providing device, the plug thereby rotatably removable from within the flange; and wherein when the torque is applied to the torque ring by the torque-providing device in a closing direction the axially-protruding resilient finger engages the finger aperture to transfer the torque from the torque ring to the torque collar permitting the torque collar to rotate the plug in the closing direction, thereby compressing the gasket, until the torque overcomes the resisting force of the axially-protruding resilient finger whereupon the axially-protruding resilient finger disengages from the finger aperture resulting in the torque ring continuing to rotate in the closing direction independent of the torque collar and the plug such that the torque applied to the plug in the closing direction is limited, the compressed gasket remains free of damaged as a result of the compression, and the container is sealed such that the container resists leakage.

38. The system of claim 37, wherein the container comprises a 55-gallon metal drum.

39. The system of claim 37, wherein the flange comprises at least one of a two-inch flange and a three-quarters inch flange.

40. The system of claim 37, wherein the system further comprises a cap seal capable of providing protection from leaks, the cap seal being secured to the plug after the plug has been secured within the flange disposed upon the container.

41. A method of limiting torque applied by a torque-providing device, the method comprising:

providing a plug having a torque-limiting apparatus, the torque-limiting apparatus comprising:

a torque ring rotatably seatable upon the plug, the torque ring having a torque ring aperture capable of engaging the torque-providing device and an axially-protruding resilient finger providing a resisting force; and a torque collar securable to the plug and holding the torque ring rotatably captive, the torque collar having a torque collar aperture capable of receiving the torque-providing device and a finger aperture capable of receiving and engaging the axially-protruding resilient finger;

applying torque, in a closing direction, to the torque ring using the torque-providing device;

engaging the axially-protruding resilient finger of the torque ring and the finger aperture of torque collar to translate the torque to the plug;

rotating the plug, in the closing direction, until the torque overcomes a resisting force of the axially-protruding resilient finger; and disengaging the axially-protruding resilient finger of the torque ring and the finger aperture of torque collar when the torque overcomes the resisting force, thereby pennitting the torque ring to rotate relative to the torque collar, and limiting the torque that can be applied to the plug.

42. The method of claim 41, wherein the plug having the torque-limiting apparatus is one of a used plug, a re-used plug, an existing plug, an old plug, and a recycled plug.

43. The method of claim 41, the torque-limiting apparatus is retro-fitted to a used plug, a re-used plug, an existing plug, an old plug, and a recycled plug.

44. The method of claim 41, wherein the relative rotation permits the torque ring to continue rotating while rotation of the torque collar ceases.

45. The method of claim 41, wherein disengagement causes the axially-protruding resilient finger to be one of biased toward the plug, biased away from the torque collar, flattened by the torque collar, forced axially downwardly, and bent flush with the torque ring.

46. The method of claim 41, wherein the method further comprises inserting the plug into a flange.

47. The method of claim 46, wherein the flange is disposed within a container.

48. The method of claim 47, wherein the flange is disposed within a lid upon a container.

49. The method of claim 41, wherein the method further comprises compressing a gasket on the plug against a flange when the plug is rotated in the closing direction.

50. The method of claim 49, wherein the method further comprises sealing a container containing the flange with the compressed gasket.

51. The method of claim 41, wherein the method further comprises generating friction between the axially-protruding resilient finger and the torque collar to provide the resisting force.

52. The method of claim 41, wherein the method further comprises generating friction between the axially-protruding resilient finger and the torque collar, the friction being augmented by upward protrusion of the axially-protruding resilient finger, to provide the resisting force.

53. The method of claim 52, wherein the method further comprises overcoming the resisting force prior to damaging a gasket used with the plug.

54. The method of claim 52, wherein the method further comprises inhibiting or preventing damage to a gasket used with the plug by disengaging the torque ring and the torque collar when the resisting force is overcome.

55. The method of claim 41, wherein the method further comprises applying torque, in an opening direction, to the torque ring using the torque-providing device, engaging the axially-protruding resilient finger of the torque ring and the finger aperture of torque collar to translate the torque to the plug, and rotating the plug in the opening direction until the torque-providing device ceases to apply the torque.

56. The method of claim 41, wherein the method further comprises applying torque, in an opening direction, to the torque ring using the torque-providing device, engaging a front surface of the axially-protruding resilient finger of the torque ring and a camming surface of the finger aperture of torque collar to translate the torque to the plug, and rotating the plug in the opening direction until the torque-providing device ceases to apply the torque.

57. The method of claim 55, wherein the method further comprises decompressing a gasket associated with the plug, and thereafter removing the plug from a flange, without damaging the plug.

58. A method of limiting torque applied by a torque-producing device, the method comprising:

providing an assembly comprising a plug having a gasket, a flange, and a torque-limiting apparatus, the torque-limiting apparatus having:

a torque ring rotatably seatable upon the plug, the torque ring having a torque ring aperture capable of engaging the torque-providing device and an axially-protruding resilient finger providing a resisting force; and a torque collar securable to the plug and holding the torque ring rotatably captive, the torque collar having a torque collar aperture capable of receiving the torque-providing device and a finger aperture capable of receiving and engaging the axially-protruding resilient finger;

inserting the plug into the flange and applying torque, in a closing direction, to the torque ring using the torque-providing device;

engaging the axially-protruding resilient finger of the torque ring and the finger aperture of torque collar to translate the torque to the plug;

rotating the plug within the flange, in the closing direction, until:

the gasket is compressed between the plug and the flange; and the torque overcomes a resisting force of the axially-protruding resilient finger; and disengaging the axially-protruding resilient finger of the torque ring and the finger aperture of torque collar when the torque overcomes the resisting force thereby permitting the torque ring to rotate relative to the torque collar and thus limiting the torque that can be applied to the plug.

59. A method of sealing a container, the method comprising:

providing an assembly comprising a plug having a gasket, a flange within the container, and a torque-limiting apparatus, the torque-limiting apparatus having:

a torque ring rotatably seatable upon the plug, the torque ring having a torque ring aperture capable of engaging the torque-providing device and an axially-protruding resilient finger providing a resisting force; and a torque collar securable to the plug and holding the torque ring rotatably captive, the torque collar having a torque collar aperture capable of receiving the torque-providing device and a finger aperture capable of receiving and engaging the axially-protruding resilient finger;

inserting the plug into the flange and applying torque, in a closing direction, to the torque ring using the torque-providing device;

engaging the axially-protruding resilient finger of the torque ring and the finger aperture of torque collar to translate the torque to the plug;

rotating the plug within the flange, in the closing direction, until:

the gasket is compressed between the plug and the flange; and the torque overcomes a resisting force of the axially-protruding resilient finger;

disengaging the axially-protruding resilient finger of the torque ring and the finger aperture of torque collar by permitting the torque collar to bias the resilient finger into the torque ring; and discontinuing translation of the torque provided by the torque-providing device from the torque ring to the torque collar such that the compressed gasket forms a seal upon the container without damaging the gasket.

* * * * *